US010094060B2

(12) United States Patent
Frucco et al.

(10) Patent No.: US 10,094,060 B2
(45) Date of Patent: Oct. 9, 2018

(54) METHOD FOR WASHING LAUNDRY IN A LAUNDRY WASHING MACHINE AND LAUNDRY WASHING MACHINE

(75) Inventors: Giuseppe Frucco, Pordenone (IT); Mirko Gasparini, Spilimbergo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 184 days.

(21) Appl. No.: 14/007,294

(22) PCT Filed: Mar. 23, 2012

(86) PCT No.: PCT/EP2012/055225
§ 371 (c)(1),
(2), (4) Date: Sep. 24, 2013

(87) PCT Pub. No.: WO2012/127039
PCT Pub. Date: Sep. 27, 2012

(65) Prior Publication Data

US 2014/0013519 A1 Jan. 16, 2014

(30) Foreign Application Priority Data

Mar. 24, 2011 (EP) ..... 11159595

(51) Int. Cl.
*D06F 33/02* (2006.01)
*D06F 39/02* (2006.01)
*D06F 35/00* (2006.01)

(52) U.S. Cl.
CPC ..... *D06F 33/02* (2013.01); *D06F 35/006* (2013.01); *D06F 39/02* (2013.01); *D06F 2204/086* (2013.01)

(58) Field of Classification Search
CPC ..... D06F 33/02; D06F 33/00; D06F 39/008; D06F 39/006; D06F 39/083;
(Continued)

(56) References Cited

U.S. PATENT DOCUMENTS 5,345,637 A 9/1994 Pastryk et al.
2008/0201867 A1* 8/2008 Bang et al. ..... 8/158
2008/0276972 A1* 11/2008 Luckman ..... D06F 35/006 134/33

FOREIGN PATENT DOCUMENTS

CN 1616742 A * 5/2005
CN 101255641 A 9/2008
(Continued)

OTHER PUBLICATIONS

International Search Report dated Jul. 11, 2012 in corresponding International Application PCT/EP2012/055225.
European Search Report dated Dec. 1, 2011 in corresponding EP Application 11159595.5.
(Continued)

*Primary Examiner* — Michael E Barr
*Assistant Examiner* — Tinsae B Ayalew
(74) *Attorney, Agent, or Firm* — RatnerPrestia

(57) ABSTRACT

The present invention relates a to a method for washing laundry in a laundry washing machine comprising a washing tub external to a rotatable washing drum suited to receive laundry; the method comprises loading laundry into the washing drum and a laundry wetting phase for this laundry. The wetting phase comprises the steps of: —filling the washing tub with a first quantity of clean water at least equal to the quantity of water necessary to wet the loaded laundry completely, so as to obtain the complete wetting of the loaded laundry; —if a quantity of free water is present in the washing tub, externally to the laundry, draining from the washing tub this quantity of free water; —adding a given quantity of detergent to the loaded laundry.

11 Claims, 6 Drawing Sheets

(58) Field of Classification Search
CPC ..... D06F 39/003; D06F 39/04; D06F 39/02; D06F 39/087; D06F 39/10; D06F 39/082; D06F 39/088; D06F 39/005; D06F 39/028; D06F 39/08; D06F 39/14; D06F 2202/085; D06F 2202/10; D06F 2202/04; D06F 2202/12; D06F 2204/086; D06F 2204/082; D06F 2204/04; A47L 15/449; A47L 2301/04; A47L 2401/023; A47L 2401/04; A47L 2501/07
USPC ..... 8/158, 149.3, 159, 137, 148, 149.1, 8/149.2; 68/5 R, 15, 5 C, 12.02, 12.04, 68/12.05, 17 R, 207, 12.12, 12.19, 12.27, 68/12.01, 12.18, 12.21, 12.22, 18 C, 19
See application file for complete search history.

(56) References Cited

FOREIGN PATENT DOCUMENTS

| | | | |
|---|---|---|---|
| DE | 4009046 | A1 | 9/1991 |
| EP | 1961854 | A1 | 8/2008 |
| KR | 10-2006-0124221 | A | 7/2007 |
| WO | 2006129913 | A1 | 12/2006 |
| WO | WO 2006129913 | A1 * | 12/2006 |

OTHER PUBLICATIONS

Office Action dated May 17, 2013 in corresponding EP Application 11159595.5.
Jun. 12, 2015 (CN)—Office Action App. No. 201280014658.7.

* cited by examiner

METHOD FOR WASHING LAUNDRY IN A LAUNDRY WASHING MACHINE AND LAUNDRY WASHING MACHINE

The present invention concerns the field of laundry washing techniques. In particular, the present invention refers to a method for washing laundry in a laundry washing machine.

BACKGROUND ART

Nowadays the use of laundry washing machines, both "simple" laundry washing machines (i.e. laundry washing machines which can only wash and rinse laundry) and washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub inside which there is a rotatable perforated drum in which the laundry is placed.

A loading/unloading door ensures access to the tub and the drum.

Laundry washing machines typically comprise a detergent supply unit and a water inlet circuit for the introduction of water and washing/rinsing products (i.e. detergent, softener, etc.) into the tub.

Known laundry washing machines are also provided with water draining devices that may operate both during the initial phases of the washing cycle and at the end of the same to drain the dirty water.

In particular, a known complete washing cycle typically includes a first laundry wetting phase with addition of the washing detergent, a second washing phase during which the tub is rotated and the water contained therein is heated to predetermined temperature values based on the washing programme selected by the user, and a final rinsing and spinning phase.

According to the known technique, the initial wetting phase includes successive steps intended to determine the quantity of water necessary for wetting the laundry completely and to introduce said water in the tub, as well as to proportion the detergent correctly according to the type of laundry to be washed. A wetting method is disclosed in document EP1961854. In this document the wetting phase includes first the determination of the load in terms of weight of the laundry, in order to establish the minimum quantity of washing water to be introduced in the tub.

Successively this quantity of washing water, consisting of water and detergent, is introduced in the tub.

Then further washing water is introduced until it is detected that a minimum level of washing water has been reached inside the tub, while at the same time the laundry is wetted.

The minimum level depends on the type of programme selected and on the quantity and type of laundry.

Suitable level sensors detect that the minimum level has been reached.

Once the introduction of washing water in the tub has been interrupted, the washing water that remains in the hollow space between the tub and the drum is drained and reintroduced in the tub through a special hydraulic circuit that pumps the washing water from the bottom of the tub to a nozzle arranged in the upper part of the tub.

The washing water that is reintroduced further wets the laundry.

Successively, the quantity of washing water present on the bottom of the tub is measured and further water is added until reaching a minimum level, so as to cover the heating means consisting of a resistor positioned at the base of the tub. Then the cycle continues through the control of both the level of the water present inside the tub and the temperature reached by the water itself, so as to guarantee that the washing cycle is carried out at the correct temperature according to the set programme.

However, the method of wetting the laundry above described belonging to the known art pose some drawbacks.

A first drawback posed by this known technique is constituted by the fact that the wetting phase lasts a long time.

A further drawback is represented by the fact that perfect and homogeneous wetting of the laundry is not guaranteed.

A further drawback lies in that part of the detergent is mixed with the washing water that fills the hollow space, said water being in excess of the quantity of water that is sufficient to wash the laundry and to wet it completely.

The object of the present invention is therefore to overcome the drawbacks posed by the known technique.

It is a first object of the invention to implement a wetting method for a washing cycle of a laundry washing machine that is quicker than the methods of known type.

It is a further object of the invention to implement a wetting method that makes it possible to obtain more efficient wetting of the laundry compared to the known technique.

It is another object of the invention to implement a wetting method that makes it possible to optimise the dosage of the detergent and to reduce the quantity of detergent used compared to the known technique.

SUMMARY

The present invention therefore relates, in a first aspect thereof, to a method for washing laundry in a laundry washing machine comprising a washing tub external to a rotatable washing drum suited to receive laundry; the method comprises loading laundry into the washing drum and a laundry wetting phase for this laundry. The wetting phase comprises the steps of:

- filling the washing tub with a first quantity of clean water at least equal to the quantity of water necessary to wet the loaded laundry completely, so as to obtain the complete wetting of the loaded laundry;
- if a quantity of free water is present in the washing tub, externally to the laundry, draining from the washing tub this quantity of free water;
- adding a given quantity of detergent to the loaded laundry.

In a preferred embodiment the first quantity of clean water exceeds the quantity of water necessary to wet the loaded laundry completely.

Advantageously the first quantity of clean water is stated based on the quantity and/or on the type of the loaded laundry.

Preferably after the step of filling the washing tub with a first quantity of clean water at least equal to the quantity of water necessary to wet the loaded laundry completely, so as to obtain the complete wetting of the loaded laundry, the method comprises the step of extracting from the completely wet loaded laundry a quantity of water, and draining this quantity of water from the tub.

Advantageously the step of extracting from the completely wet loaded laundry the above mentioned quantity of water comprises a rotation phase of the drum so as to extract this quantity of water from the loaded laundry by squeezing.

Preferably the draining of the quantity of water from the tub is performed during the rotation phase of the drum.

In a further embodiment, the draining of the quantity of water from the tub is performed after the rotation phase of the drum.

Preferably the step during which a given quantity of detergent is added to the laundry comprises also the addition of a second quantity of water into the washing tub.

Advantageously the whole or a part of the water drained from the tub is drained towards a water storage area of the laundry washing machine.

In this case the above mentioned second quantity of water may be advantageously taken form the water stored in the water storage area.

Advantageously, the step of filling the washing tub with a first quantity of clean water continues until the laundry is completely immersed and is below a wetting level.

In a further embodiment, the step of filling the washing tub with a first quantity of clean water continues until the washing tub has completely been filled.

Opportunely, the method may comprise a phase of usage of the water stored in the water storage area.

Preferably, the phase of usage of the water stored in the water storage area is a rinsing phase.

Opportunely, the method of the invention may comprise a phase for heating the first quantity of clean water.

Advantageously, the phase for heating the first quantity of clean water may be performed inside the tub.

In a further embodiment, the phase for heating the clean water is performed before the step of filling the washing tub with a first quantity of clean water.

In an alternative embodiment, the method comprises a phase for heating the water inside the tub after the addition of the detergent.

Preferably, the phase for heating is obtained with heating means which belongs to the group comprising: electric resistance, air heater, steam, micro waves and combinations thereof.

In a second aspect thereof, the present invention concerns a laundry washing machine suited to implement the method of the invention described above.

BRIEF DESCRIPTION OF THE DRAWINGS

Further characteristics and advantages of the present invention will be highlighted in greater detail in the following detailed description of some of its preferred embodiments, provided with reference to the enclosed drawings. In said drawings.

Figure 1:
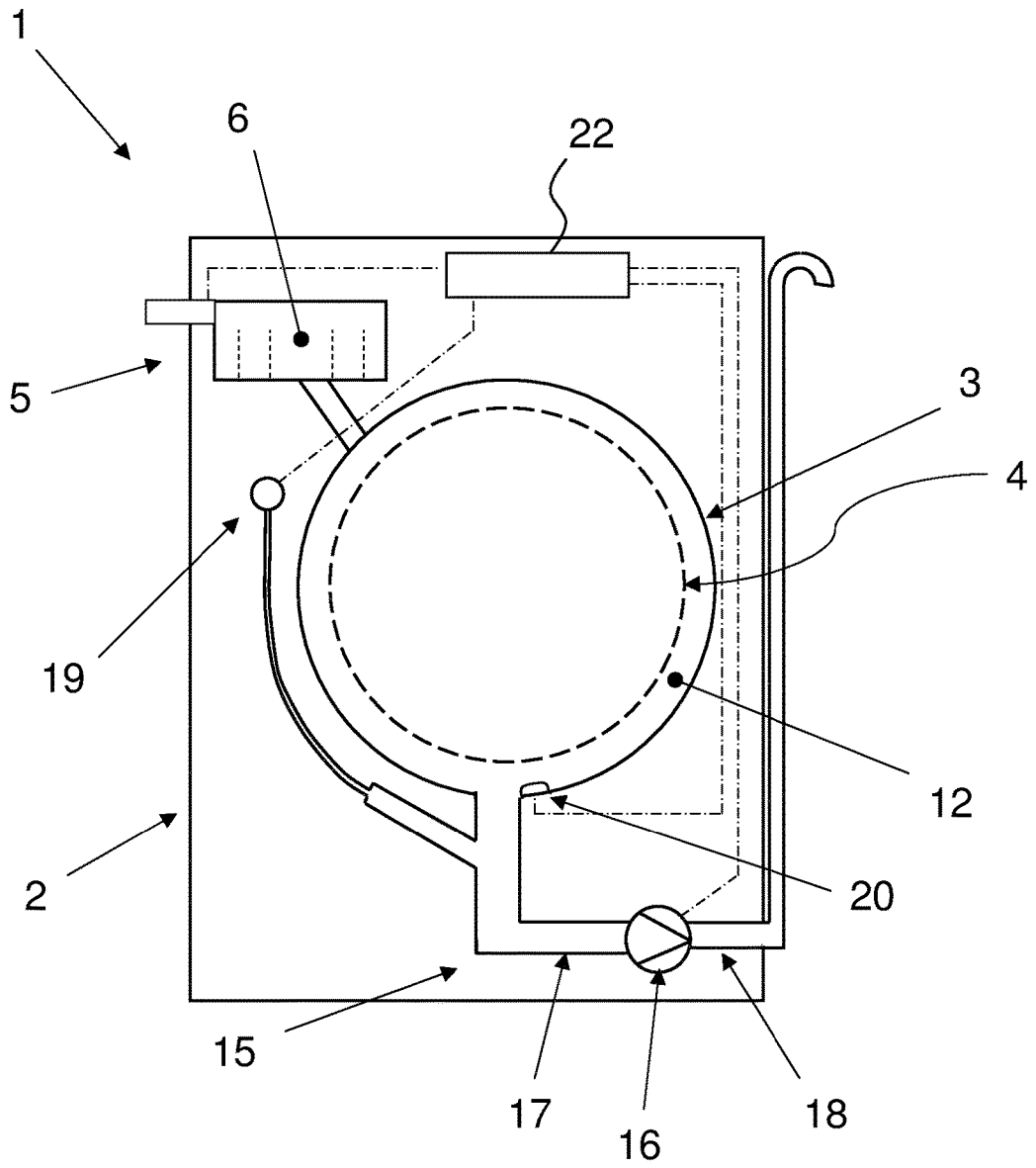
FIG. 1 shows a front view of a laundry washing machine implementing the method according to a first embodiment of the invention.
Figure 6:
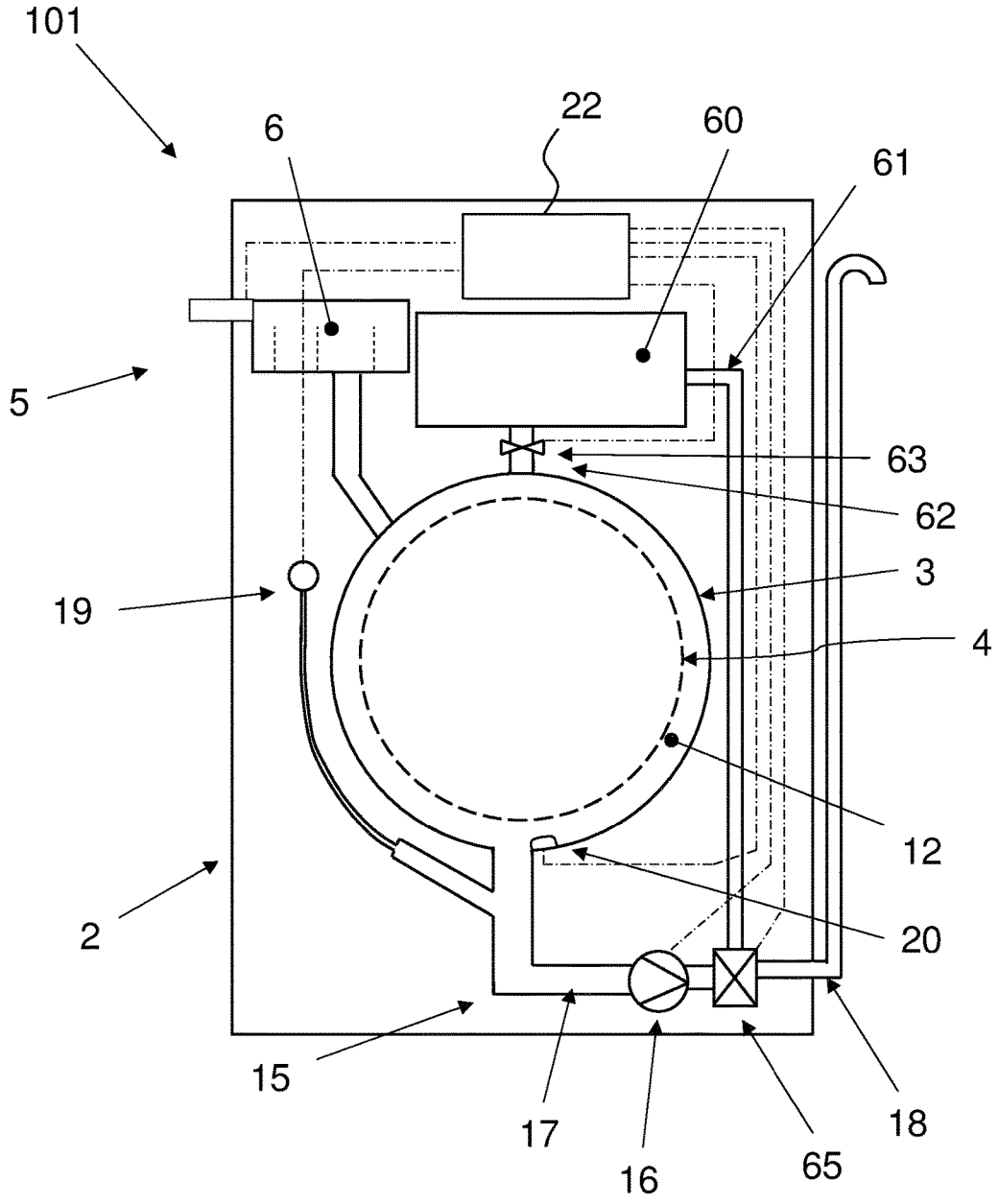

FIGS. from 3 to 5 show different phases of the washing method according to the first embodiment of the invention performed in the laundry washing machine of FIG. 1;

FIG. 6 shows a construction variant of the laundry washing machine shown in FIG. 1.

DETAILED DESCRIPTION OF CERTAIN EMBODIMENTS

Figure 2:
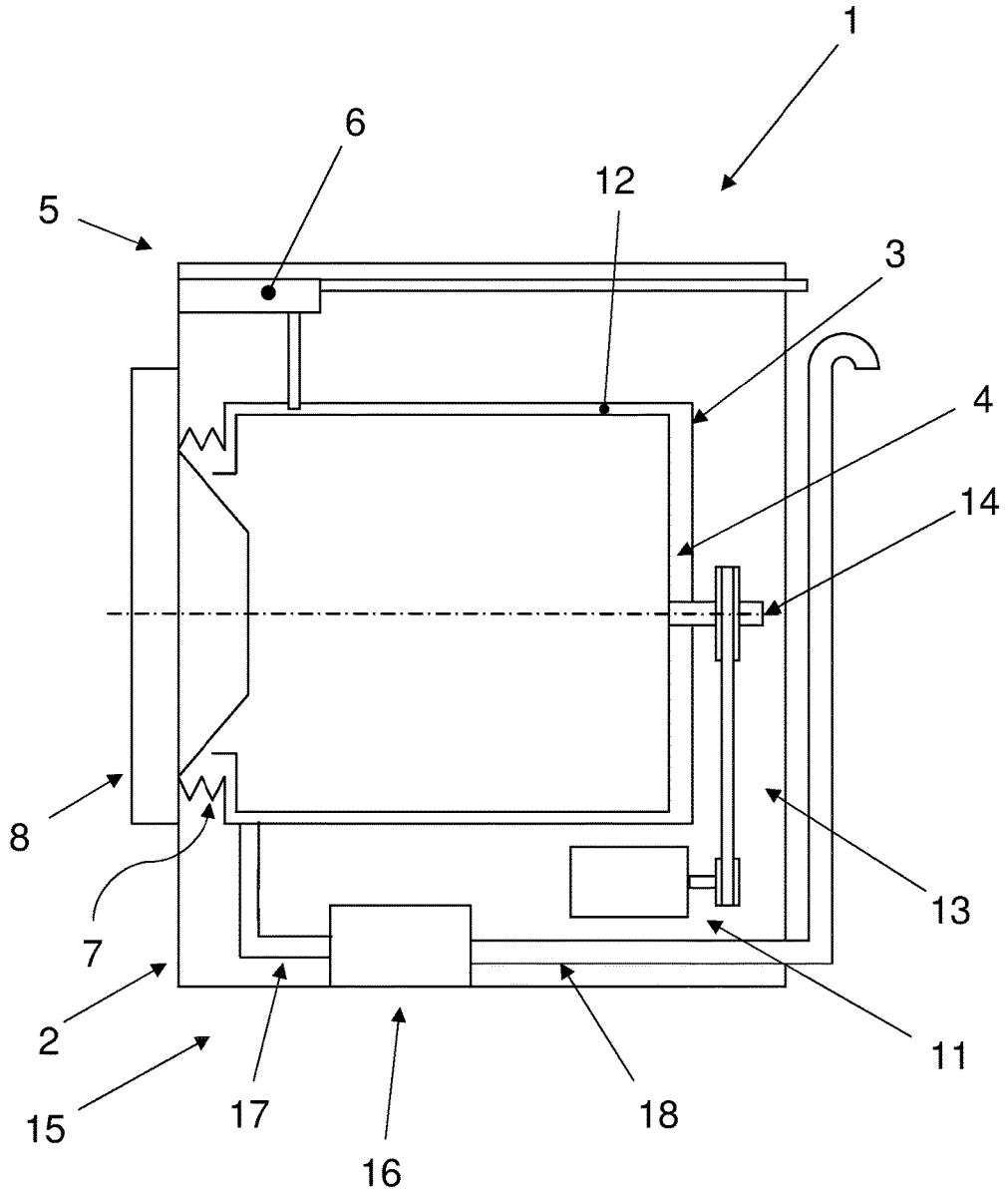
FIG. 2 shows a side view of the laundry washing machine shown in FIG. 1.

With reference to FIG. 1 and FIG. 2, a laundry washing machine 1 is illustrated, in which a method according to a first embodiment of the invention is advantageously implemented.

The laundry washing machine 1 comprises an external casing or housing 2, in which a washing tub 3 is provided that contains a rotatable perforated drum 4, where the laundry 30 to be washed can be loaded.

The tub 3 and the drum 4 both have preferably a substantially cylindrical shape. A hollow space 12 is defined between the tub 3 and the drum 4.

The housing 2 is provided with a loading/unloading door 8 which allows access to the washing tub 3 and the drum 4.

The tub 3 is preferably suspended in a floating manner inside the housing 2, advantageously by means of a number of coil springs and shock-absorbers that are not illustrated herein.

The tub 3 is preferably connected to the casing 2 by means of an elastic bellows 7, or gasket.

The drum 4 is advantageously rotated by an electric motor 11 which preferably transmits the rotating motion to the shaft 14 of the drum 4, advantageously by means of a belt/pulley system 13. In a different embodiment of the invention, the motor 11 can be directly associated with the shaft 14 of the drum 4.

A water inlet circuit 5 is arranged, preferably in the upper part of the laundry washing machine 1, and is suited to supply water and washing/rinsing products (i.e. detergent, softener, etc.) into the tub 3.

The water inlet circuit 5 advantageously comprises a removable drawer 6 provided with various compartments suited to be filled with washing and/or rinsing products.

The water inlet circuit of a laundry washing machine is well known in the art, and therefore will not be described in detail.

In the embodiment herein described, the water is supplied into the tub 3 by making it flow through the drawer 6.

In a preferred embodiment, the water which reaches the tub 3 can selectively contain one of the products contained in the compartments of the drawer, or such water can be clean and in this case it may reach the tub 3 directly, bypassing the compartments of the drawer 6.

In an alternative embodiment of the invention, a further separate water supply pipe can be provided, which supplies exclusively clean water into the tub 3.

The water inlet circuit 5 also preferably comprises a water flow sensor, for example a flow meter, which makes it possible to calculate the quantity of water supplied into the tub 3.

Laundry washing machine 1 advantageously comprises a water outlet circuit 15. The water outlet circuit 15 advantageously comprises a drain pump 16, a first pipe 17 connecting the tub 3 to the drain pump 16 and an outlet pipe 18 ending outside the housing 2. The water outlet circuit 15 is suited to drain the liquid, i.e. dirty water or water mixed with washing and/or rinsing products, from the tub 3 to the outside of the washing machine 1.

The water outlet circuit 15 advantageously comprises a filtering device, not shown in the figures, placed between the bottom of the tub 3 and the drain pump 16 and adapted to retain all the undesirable bodies (for example buttons that have come off the laundry, coins erroneously introduced into the laundry washing machine, etc.) that have passed through the holes located on the surface of the drum 4, or fallen onto the bottom of the tub 3 while passing between the drum 4 and the tub 3, which could damage or obstruct the drain pump 16.

This filtering device can preferably be removed, and then for example cleaned, through a gate placed advantageously on the front or back wall of the housing 2 of the laundry washing machine 1, not shown herein; in a further embodiment, not illustrated, the filtering device can be accessed for example by the internal of the drum 4, for example by a suitable opening obtained therein and selectively closed by a suitable cover, or by a removable lifter of the drum 4.

The water outlet circuit 15 can be advantageously also provided with a recirculation circuit adapted to drain the washing/rinsing liquid from the bottom of the tub 3, and to re-admit such liquid into an upper region of the tub, for improving the wetting of the laundry. The recirculation circuit of a washing machine is well known in the art, and therefore will not be described here.

Advantageously laundry washing machine 1 comprises a device 19 suited to sense (or detect) the water level inside the tub 3.

The device 19 preferably comprises a pressure sensor which senses the pressure in the tub 3, which value is related to the level of free water contained in the tub. In another embodiment, not illustrated, laundry washing machine 1 advantageously comprises (in addition to, or as a replacement of, the pressure sensor) a level sensor (for example mechanical, electro-mechanical, optical, etc.) adapted to sense (or detect) the water level inside the tub 3.

Advantageously, but not necessarily, the laundry washing machine 1 comprises a heating element 20, contained preferably in a suitable seat, not illustrated, obtained advantageously at the bottom of the tub 3, comprising preferably an electric resistor adapted to come into contact with the water, or water and detergent, present on the bottom of the tub 3 to heat said water.

Advantageously laundry washing machine 1 comprises a temperature sensor, not illustrated in the figures, for sensing the temperature of the water present in the tub 3.

Laundry washing machine 1 advantageously comprises a control unit 22 connected to the various parts of the laundry washing machine 1 in order to ensure its operation. The control unit 22 preferably is connected to the water inlet circuit 5, the water outlet circuit 15 and the electric motor 11 and advantageously receives information from the various sensors provided on the laundry washing machine 1, like the flow meter of the water inlet circuit 5, the pressure sensor 19 (or the level sensor) on the bottom of the tub 3 (level sensor), the temperature sensor, etc.

Laundry washing machine 1 advantageously comprises an interface unit, not visible in the enclosed figures, connected to control unit 22, accessible to the user and by means of which the user may select and set the washing, for example the desired washing program. Preferably, other parameters can optionally be inserted by the user, for example the washing temperature, the spinning speed, the load in terms of weight of the laundry to be washed, etc.

Based on the parameters acquired by said interface, the control unit 22 sets and controls the various parts of the laundry washing machine 1 in order to carry out the desired washing program.

A first embodiment of the washing method that is the subject of the invention is described here below with reference to FIGS. from 3 to 5.

The laundry 30 to be washed, usually dry, is first placed inside the drum 4. Once the user has selected the desired washing programme, the control unit 22 sets the laundry washing machine 1 so that it starts the washing cycle. Alternatively the laundry 30 may be loaded in the drum 4 after the selection of the desired washing programme.

During the first phase, also called wetting phase, the laundry 30 is prepared by wetting it completely and adding detergent for the successive washing phases, as explained below.

Once the laundry 30 has been introduced in the drum 4, a first prefixed quantity Q1 of clean water is introduced in the tub 3. The prefixed quantity Q1 of clean water is preferably defined before its introduction in the tub 3, as will be described in greater detail below, in such a way to at least completely wet the loaded laundry 30. Preferably, the introduction of clean water takes place quickly through the water inlet circuit 5, which will provide for feeding clean water into the tub 3. Preferably the introduction of the quantity Q1 of clean water is performed in a single step (i.e. it is introduced in a continuous way, without any pause in the flowing of water).

The quantity of clean water which is introduced in the tub 3 may be measured, during its introduction, for example by a flow meter, not illustrated, provided in the water inlet circuit 5, or by processing other parameters, for example the pressure of the delivered water and the duration of the water delivery; in this way it is possible to introduce into the tub 3 exactly a prefixed quantity Q1 of clean water.

In another embodiment the quantity of water introduced into the tub 3 may be measured as a function of the level of water in the tub 3, so that water introduction is stopped when water level has reached a prefixed level L1 corresponding to the water quantity Q1 previously defined. The level L1 reached by the water level in the tub 3 after introducing the quantity of water Q1 depends on the quantity (i.e. weight, amount) and on the type of the loaded laundry 30 (in fact different fibres absorbs different quantities of water). In this embodiment the control unit 22 is advantageously configured in such a way to state (e.g. to calculate, for example by applying a prefixed algorithm, or to select among a series of memorized values) which is the level L1 reached by the water level in the tub 3 after introducing the quantity of water Q1 on the basis of the weight and preferably also of the type of the loaded laundry, and to stop the introduction of water when level L1 has been reached.

It is advantageously possible to check that the water Q1 introduced has reached the set level L1, for example by reading the values supplied by the pressure sensor 19 or level sensor associated with the tub 3.

In the condition shown in FIG. 3, the first level L1 reached by the clean water inside the tub 3 is slightly below the maximum level reached by the laundry 30. In a further embodiment, the quantity of water Q1 introduced can be the quantity necessary to reach a wetting level L1 just above maximum level reached by the laundry 30, or in extreme cases the first quantity Q1 can be such as to fill the tub 3 completely.

Clearly any other measuring means may be used to check that the water introduced in the tub 3 has reached the prefixed quantity Q1.

The quantity of water Q1 is determined, as explained above, advantageously before its introduction in the tub 3.

The quantity Q1 can be determined in different ways and preferably it is based on the quantity of water Qw necessary to completely wet the laundry 30 introduced in the drum 4.

The quantity Q1 is at least equal to the quantity of water Qw necessary to wet the laundry 30 completely.

Preferably the first quantity Q1 is greater than the quantity of water Qw necessary to wet the laundry 30 completely.

In an advantageous embodiment the first quantity Q1 may correspond to the quantity of water necessary to completely fill the tub 3.

Part of the first quantity Q1 of water introduced in the tub 3 may fill the hollow space 12, and possibly also the drum 4, up to a level L1.

The water quantity Qw necessary to completely wet the laundry depends mainly on the quantity (i.e. weight, amount) of loaded laundry and on the type of laundry (in fact, for example, cotton absorbs many water that synthetic fibres, and therefore a certain quantity of laundry made of cotton requires, in order to be completely wetted, much water that a same quantity of laundry made of synthetic fibres). The control unit 22 may be advantageously configured in such a way to state (e.g. to calculate by applying a prefixed algorithm or to select among a series of memorized values) which is the water quantity Qw necessary to completely wet the laundry on the basis of the weight and preferably also of the type of the loaded laundry.

The weight of the laundry 30 can be obtained by the control unit 22 in different ways.

The weight can be, for example, one of the parameters introduced by the user when setting the washing program.

In further embodiment, the weight of the laundry 30 can be advantageously obtained by means of suitable weight sensors provided in the laundry washing machine 1, for example sensors that can be associated with the shock-absorbers of the tub 3.

Again, the control unit 22 may advantageously obtain the weight of the laundry 30 by measuring the power absorbed by the motor for the rotation of the drum 4 with the laundry 30 inserted therein. In this case, it is possible to set a brief rotation cycle of the drum 4 before the introduction of clean water, therefore with dry laundry 30, in order to measure the moment of inertia of the laundry 30 based on the power absorbed by the electric motor 11 and thus obtain the weight of the laundry 30 itself by means of simple calculations.

Clearly any other method may be used to determine the quantity of the loaded laundry 30.

The type of fabric to be washed may be advantageously communicated to the control unit 22 directly by the user, for example by the interface unit (not illustrated), when setting the washing program.

In another embodiment the control unit 22 may be configured in such a way to sense or detect the type of loaded laundry by suitable sensing/detecting means, for example optical detecting means.

Clearly any other method may be used to determine the water quantity Qw necessary to wet the laundry completely.

Preferably, but not necessarily, the first quantity Q1 of water that has to be introduced is selected, advantageously by the control unit 22, in such a way to be sufficiently higher than the quantity Qw previously established, that it is ensured that, after the quantity Q1 has been introduced in the tub 3, the laundry 30 is completely immersed in water. For example, the first quantity Q1 of water may be selected to be equal to the quantity Qw increased by a percentage which may be always the same or which may depend on the weight of the laundry loaded in the tub; for example Q1 may be [1000-2000] % of Qw for a low quantity of loaded laundry (for example 2-3 kg), or it may be [400-500] % of Qw for a high quantity of loaded laundry (for example 7-8 kg)

In a further embodiment, the first quantity Q1 of water that has to be introduced is selected, advantageously by control unit 22, so that the laundry 30 is completely immersed in the water.

The delivery of clean water may be in this case performed until reaching the maximum level inside the tub 3, a parameter that can be easily measured for example by the pressure sensor 19.

In order to favour the wetting operation, during the first water inlet phase, or immediately afterwards, the drum 4 advantageously is set rotating, preferably at a low number of revolutions, for example about 30-50 rpm, in order to move the laundry 30 and to facilitate the water in penetrating effectively therein, so as to obtain better and more homogeneous wetting of the same.

Independently of the method selected for determining the quantity of water Q1, as stated above the introduction advantageously takes place quickly, preferably through a single delivery of water into the tub 3 carried out by the water inlet circuit 5.

In order to ensure better wetting results, the laundry 30 preferably is kept in the clean water for a given lapse of time before continuing with the successive phases, for example [2-5] minutes for a [2-4] kg of laundry 30.

Figure 3:
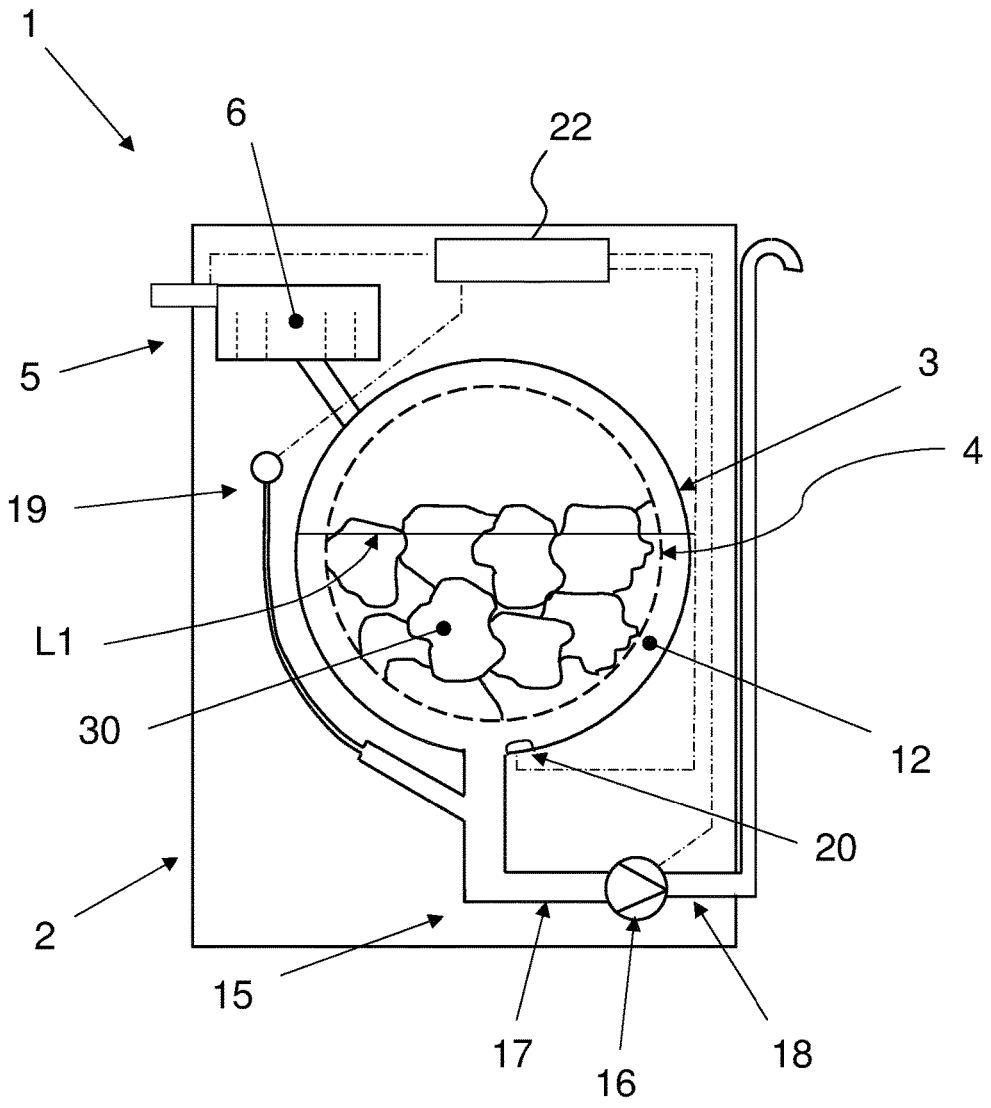

At the end of the phase described, the laundry 30 inside the drum 4 is completely wet by a quantity of water Qw, and there may be also a certain quantity of free water Qe which rests at the bottom of the tub 3 and which therefore fills at least partially the hollow space 12, and which may fill also, at least partially, the internal of the drum 4; in this condition the level of water in the tub 3 is indicated as L1 in FIG. 3. Clearly if the quantity of water Q1 introduced in the tub 3 corresponds exactly to the quantity of water Qw necessary to completely wet the laundry 30, there is no free water Qe in the bottom of the tub 3 (with the possible exception of a small quantity of water which may exit the almost fully wetted laundry 30).

In other words Qe is the quantity of free water which may remain in the bottom of the tub 3 after the rest of the water adduced into the tub 3, i.e. quantity Qw, has been absorbed by the laundry 30.

In the successive phase of the cycle, if there is some excess water Qe in the bottom of the tub 3, this excess water Qe is advantageously removed from the tub 3.

The removal operation preferably includes the drainage of the water from the tub 3 by means of the drain pump 16 that takes the water from the bottom of the tub 3 and conveys it towards the outside through the outlet duct 18.

Figure 4:
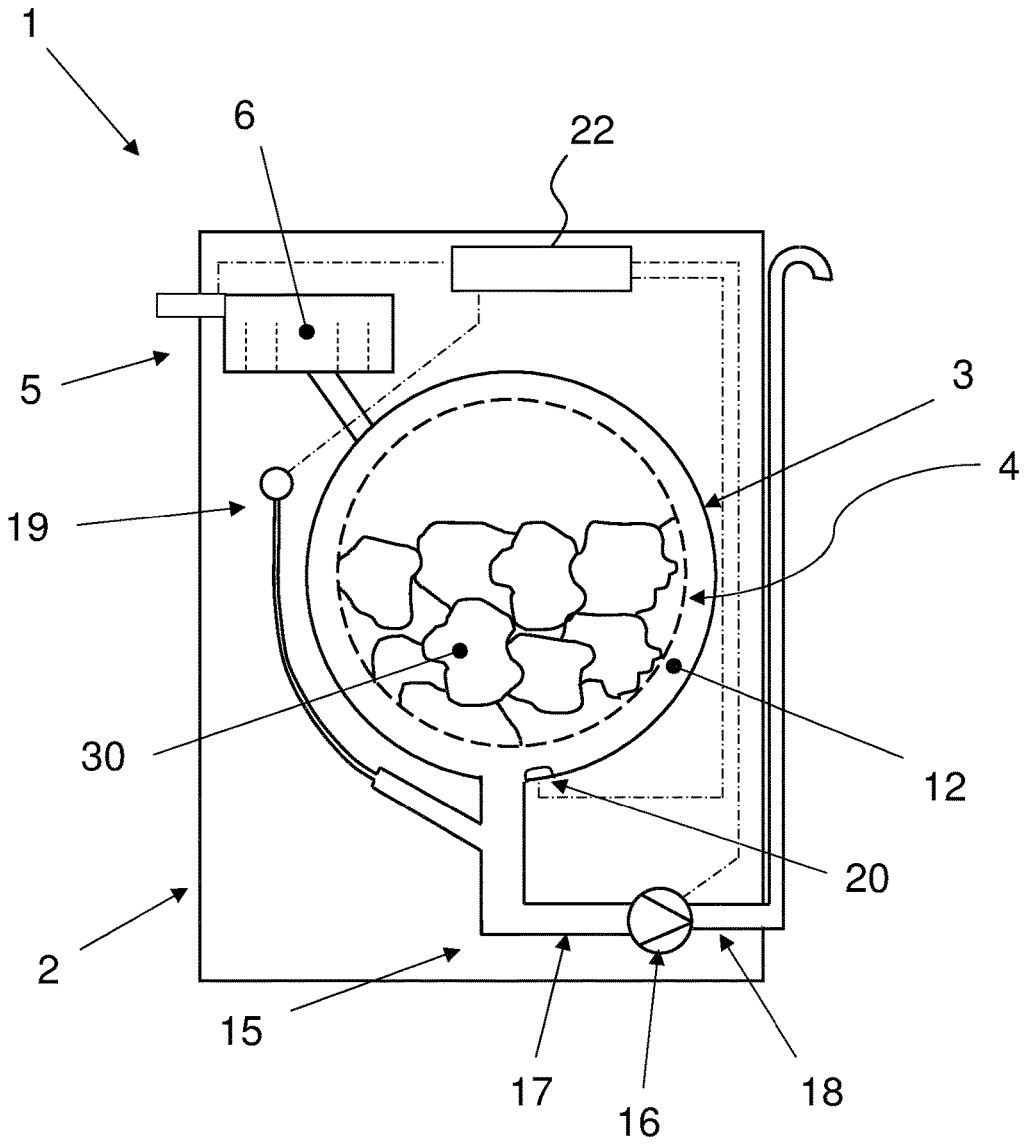

This phase ends when substantially all the excess water Qe has been drained outside the laundry washing machine 1, as shown in FIG. 4.

This is advantageously sensed by means of the pressure sensor 19 or level sensor, which senses the absence of water inside the tub 3.

In other embodiment, the drain pump 16 can be operated for a pre-established period of time deemed sufficient to empty the tub 3 completely. In this case the pressure sensor 19 can be omitted.

The quantity of water Qe drained during this phase can advantageously be measured based, for example, on the pressure values taken by the pressure sensor 19. In further embodiment, said value can be calculated by another sensing device, for example with the aid of a flow meter properly associated with the water outlet circuit 15.

At the end of the draining phase, the laundry 30 inside the drum 4 is completely wetted with a quantity Qw of clean water.

The quantity of water Qw present in the laundry 30, which is equal to the quantity of water Q1 introduced in the tub 3 minus the possible quantity of excess water Qe (if present) drained towards the outside, is made known to the control unit 22 through the previously measured values Q1 and Qe. In the successive phase the washing detergent is advantageously introduced in the drum 4.

The quantity of detergent Qd that must be introduced in the drum 4, and that is taken preferably from the drawer 6, is determined advantageously by the control unit 22.

The quantity of detergent Qd is preferably based on the washing program selected by the user, and advantageously depends on the quantity (i.e. weight, amount) and, preferably, also on the type of loaded laundry 30.

The quantity of detergent Qd is advantageously introduced as a function (e.g. a percentage) of the quantity of water Qw that wet the laundry 30 and/or of the loaded quantity of laundry 30.

Clearly any other means may be used for determining the quantity of detergent Qd that must be introduced in the drum 4.

Figure 5:
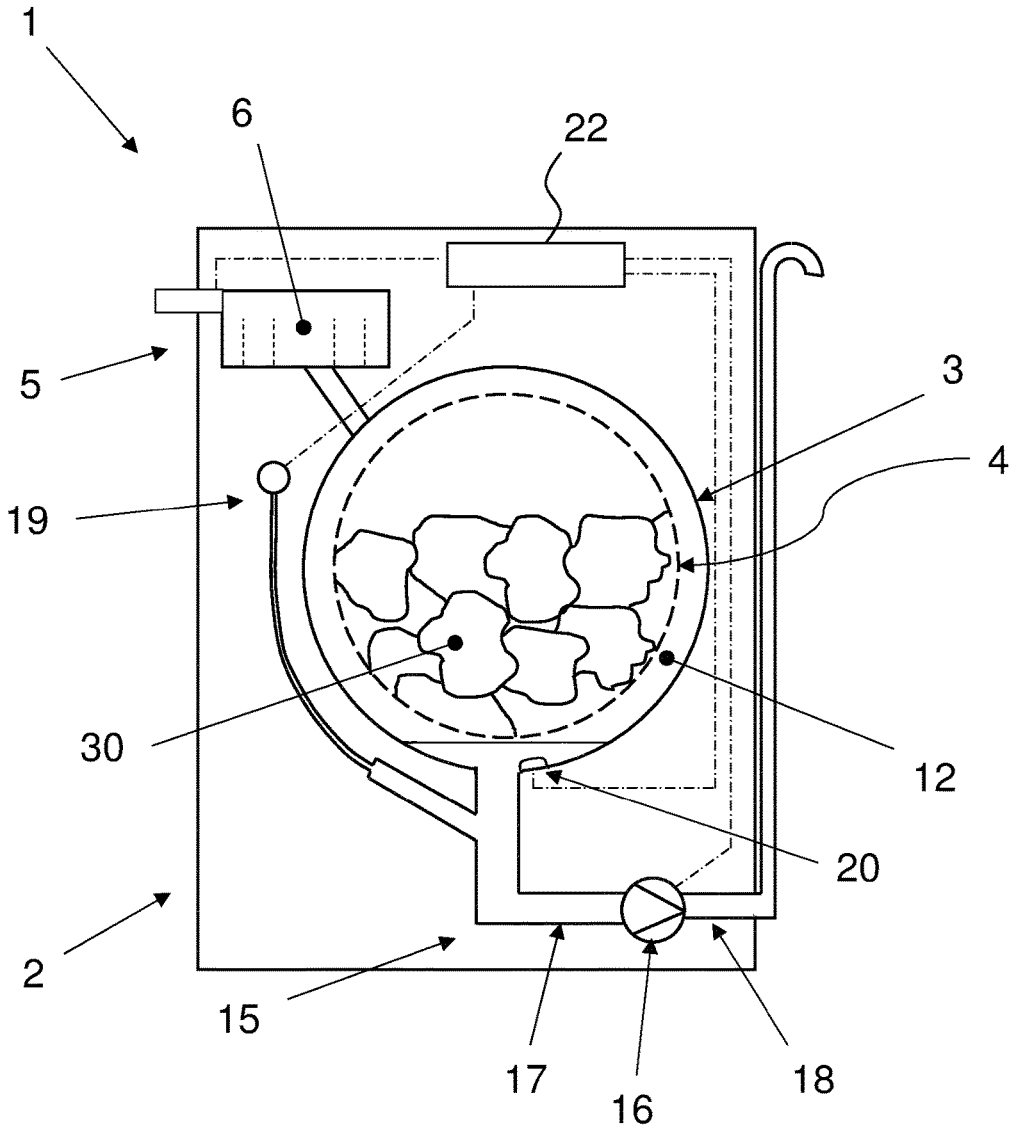

The introduction of detergent takes place preferably through the water inlet circuit 5; said quantity of detergent Qd, be it powder or liquid, is preferably brought out of the apposite compartment of the drawer 6 by a given quantity Qm of clean, detergent conveying water that passes through the proper compartment. After said introduction, as shown in FIG. 5, inside the drum 4 there will be the laundry 30 with a suitable water-detergent ratio. In this case on the bottom of the tub 3 there is advantageously a minimum quantity of excess water and detergent, sufficient to cover the heating element 20. The excess quantity of water and detergent substantially corresponds to the quantity of detergent conveying water Qm introduced with the detergent.

Advantageously the quantity of detergent Qd and the quantity of detergent conveying water Qm are stated (e.g. calculated of selected among a series of memorized values) by the control unit 22 depending on the quantity of water Qw in such a way that the ratio between the quantity of detergent and the total quantity of water inside the tub 3 (Qd/(Qw+Qm)) has an optimal value Ropt, depending on the quantity (i.e. weight, amount) and on the type of the loaded laundry 30. This optimal value Ropt allows obtaining the better washing performances. At this point the wetting phase can be considered completed and the washing operation can continue with the successive washing cycles of known type.

In the embodiment of the invention described above in which, after admission of detergent, on the bottom of the tub 3 there is an amount of washing liquid sufficient to cover the heating element 20, the washing liquid may be heated by activating the heating element 20.

In different embodiments of the invention, however, the washing liquid can be heated in different ways, for example through microwaves, vapour, air heaters, etc.

In these cases no liquid is needed on the bottom of the tub 3, since these heating means may heat the water directly inside the laundry 30.

In a further embodiment of the invention, in the wetting phase the detergent inlet phase may advantageously include only the introduction of a suitable quantity of detergent Qd', that is, without using any detergent conveying water Qm. This can be obtained, for example, by blowing in a pre-established quantity of detergent powder, or by using detergent tablets, or by using a detergent distributor (for example a peristaltic pump) adapted to directly inject liquid or powder detergent into the tub 3 or drum 4. In this case the quantity of detergent Qd' to be introduced is preferably selected in such a way that the ratio between the quantity of detergent and the total quantity of water inside the tub 3 (Qd'/Qw) is equal to the above defined optimal value Ropt, depending on the quantity (i.e. weight, amount) and on the type of the loaded laundry 30. It is clear that in this case the quantity of detergent Qd' necessary to obtain the optimal value Ropt is smaller than the quantity of detergent Qd necessary to obtain the same optimal value Ropt value if also detergent conveying water Qm is introduced in the tub 3.

In this case, the heating methods described above without the heating element on the bottom of the tub 3 are the preferred ones, since they don't require the presence of liquid in the bottom of the tub 3.

The same advantage described herein, permitting the use of a reduced quantity of detergent Qd', can be obtained with a different embodiment of the method.

In this different embodiment, after a first filling phase of the water quantity Q1 (which preferably remains the same described above), a certain part Qr of the water Qw contained in the laundry 30 is extracted from the latter and is removed from the tub 3. If the bottom of the tub 3 contains also a certain quantity of free water Qe, also the latter is drained together with the quantity Qr.

The further quantity of water Qr is extracted from the laundry 30 advantageously through a light spinning cycle, by setting the drum 4 rotating, preferably at low rpm, as for example at [300-400] rpm for [2-4] kg of laundry 30.

Advantageously, during this light spinning cycle the quantity of water extracted from the laundry 30 is monitored (continuously or not) by the control unit 22, for example by monitoring the level of the water in the tub 3, preferably via the pressure sensor 19 or level sensor, so as to stop the rotation of the drum when the desired quantity of water Qr has been removed from the laundry 30.

In a further embodiment the light spinning cycle is performed for a prefixed time, after which the quantity of water Qr removed from the laundry is calculated/measured, for example as a function of the level of the free water in the tub 3.

The spinning cycle preferably can take place at the same time as the water draining phase, in order to maintain low cycle times. In this case the quantity of water Qr removed from the laundry 30 during the light spinning may be calculated for example by a flow meter properly associated with the water outlet circuit 15.

In another embodiment, a first draining phase of the water quantity Qe (if present) can be carried out, as described above for the first embodiment of the invention, followed by a light spinning cycle with extraction of the quantity Qr from the laundry 30 and by a further draining phase intended to expel said quantity Qr.

At the end of this phase a quantity of water Qe' equal to Qe+Qr has been drained towards the outside.

The quantity of water Qe' drained during that phase can be advantageously measured by the control unit 22 using for example the same methods described above for measuring the quantity Qe drained from the tub 3.

The wetting water remaining in the laundry 30 corresponds in this case to the difference Qw−Qr.

In the successive phase, however, a quantity of detergent Qd" is introduced in the drum 4 through a given quantity of clean, detergent conveying water Qm'. The quantity Qm' of detergent conveying water preferably is set equal to the quantity of water Qr previously extracted from the laundry 30.

More preferably the sum of the quantity Qm' and of the detergent Qd" is substantially equal to the quantity of water Qr previously extracted from the laundry 30; for example if Qr is one liter, then one liter of a mixture of water and detergent, corresponding to Qd"+Qm', is introduced in the tub 3.

After introducing the quantity detergent Qd" and detergent conveying water of water Qm', therefore, inside the laundry 30 there is a quantity of washing liquid (i.e. water and detergent) substantially corresponding to the quantity of water Qw necessary to completely wetting the laundry 30, and therefore there isn't free water in the bottom of the tub 3.

Advantageously the quantity of detergent Qd" to be introduced is preferably selected, preferably by the control unit 22, in such a way that the ratio between this quantity of detergent and the total quantity of water inside the laundry (i.e. Qd"/(Qw−Qr+Qm')) is equal to the above defined optimal value Ropt, depending on the quantity (i.e. weight, amount) and on the type of the loaded laundry 30.

It is clear that in this case the quantity of detergent Qd" necessary to obtain the optimal value Ropt is a little smaller than the above described quantity of detergent Qd' necessary to obtain the same optimal value Ropt; in fact in this case the washing liquid which completely wets the laundry 30 comprises also the quantity of detergent Qd", and therefore the total amount of water in the tub 3 (which in this case corresponds to the water contained in the laundry 30) is a little bit lower than in the case in which no water Qr is extracted from the laundry 30.

At this point the wetting phase can be considered completed and the washing operation can continue with the known phases in the successive washing cycles. According to the above description the wetting phase with introduction of a first quantity of clean water until the wetting level is advantageously carried out more rapidly than in the known art.

Furthermore, the quantity of detergent introduced is advantageously lower than that of the detergent used in the known art, since there is less or not at all washing liquid in the hollow space between the tub and the drum.

It should be noted that if a minimum quantity of liquid is present on the bottom of the tub, this may be advantageously used to heat the liquid, water or detergent and water, and maintain it at the desired temperature during the successive washing phases.

In particular, in the heating system with heating element on the bottom of the tub, the presence of a certain quantity of liquid on the bottom is necessary.

As explained above, however, the water can be heated with different heating means that do not involve contact with the water on the bottom of the tub, and therefore it is not necessary that a certain quantity of liquid is left on the bottom of the tub.

FIG. 6 shows a construction variant of the laundry washing machine of FIG. 1.

This variant differs from the one shown in FIG. 1 due to the fact that the laundry washing machine 101 comprises a water storage area 60, or tank, preferably arranged above the tub 3.

An auxiliary outlet duct 61 connects the drain pump 16 to the tank 60, for example through a two-way valve 65.

The two-way valve 65 is properly controlled by the control unit 22 in order to allow the selective drainage towards outside through the outlet duct 18 or towards the tank 60 through the auxiliary outlet duct 61.

An inlet duct 62 connects the tank 60 to the tub 3. A valve 63, preferably a solenoid valve, is preferably arranged along the inlet duct 62 in order to be selectively opened and closed by the control unit 22.

In a further embodiment, not illustrated, the tank 60 may be connected to the tub 3 by a dedicated circuit, comprising for example a dedicated pump, in such a way that washing/rinsing liquid may be selectively drained from the tub 3 and adduced to the tank 60, and that the liquid contained in the tank 60 may be selectively adduced into the tub 3.

In the laundry washing machine of FIG. 6 it is possible to implement a variant of the washing method described above.

In particular, the water draining phases of excess water Qe and/or quantity of water Qr from the bottom of the tub 3 towards the outside advantageously are replaced, in the embodiment of FIG. 6, with draining phases into the tank 60, advantageously through the auxiliary outlet duct 61 (or through another dedicated circuit, if present). The draining phase through the auxiliary outlet duct 61 into the tank 60 is realized advantageously by properly piloting the valve 65. The remaining operations included in the wetting phase may be the same described above.

The stored clean water may be advantageously used as conveying water for conveying detergent into the washing tub 3.

The stored clean water may be advantageously used also in the successive washing phases. In particular, it can be used during the rinsing phases of the washing cycle, introducing it in the tub 3 for example through the solenoid valve 63 (or via a dedicated circuit).

It is evident that the tank 60 can be arranged in different and suitable areas of the laundry washing machine 101, for example in its lower part, in which case it will be possible to use pumps to pump the water towards the tank 60.

Advantageously, therefore, the quantity of water used to carry out a complete washing cycle will be reduced.

This embodiment, besides ensuring a reduced wetting time and optimising the quantity of detergent used for washing, also allows a reduction in the quantity of water used for a complete washing cycle.

It has thus been shown that the present invention allows all the set objects to be achieved. In particular, it makes it possible to obtain a wetting phase in a washing cycle of a laundry washing machine that is quicker and more efficient compared to the solutions of known type.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

It is underlined that the laundry washing machines illustrated in the enclosed figures, and with reference to which some embodiments of the method according to the invention have been described, are of the front-loading type; however it is clear that the method according to the invention can be applied as well to a top-loading washing machine, substantially without any modification.

The invention claimed is:

1. A method for washing laundry in a laundry washing machine comprising a washing tub external to a rotatable washing drum suited to receive laundry, said method comprising loading laundry into said washing drum and a laundry wetting phase for said laundry, wherein said laundry wetting phase comprises the steps of:

filling said washing tub with a first quantity of clean water that exceeds the quantity of water necessary to wet said loaded laundry completely, so as to obtain the complete wetting of said loaded laundry;

rotating the drum so as to extract by squeezing any free water from said loaded laundry into the washing tub, the free water being water in excess of the quantity of water to the quantity of water necessary to wet said loaded laundry completely, draining the free water from the washing tub and discharging the free water from the washing machine; and adding a given quantity of detergent to said loaded laundry after the complete wetting of said loaded laundry and said draining of free water such that the tub contains only the loaded laundry, the quantity of water necessary to wet said loaded laundry completely, and the given quantity of detergent.

2. A method according to claim 1, wherein said first quantity of clean water is determined based on the quantity and/or on the type of said loaded laundry.

3. A method according to claim 1, wherein said draining of said quantity of water from said tub is performed during said rotation phase of said drum.

4. A method according to claim 1, wherein said draining of said quantity of water from said tub is performed after said rotation phase of said drum.

5. A method according to claim 1, wherein said step during which a given quantity of detergent is added to said laundry comprises also addition of a second quantity of water into the washing tub.

6. A method according to claim 5, wherein said second quantity of water is taken from water stored in a water storage area.

7. A method according to claim 1, comprising a phase for heating said first quantity of clean water.

8. A method according to claim 7, wherein said phase for heating said first quantity of clean water is performed inside said washing tub.

9. A method according to claim 8, wherein said phase for heating said first quantity of clean water is performed after the addition of said given quantity of detergent.

10. A method according to claim 7, wherein said phase for heating said first quantity of clean water is performed before said step of filling said washing tub with said first quantity of clean water.

11. A laundry washing machine comprising:

a washing tub;

a rotatable washing drum located inside the washing tub and configured to receive laundry;

a water inlet circuit configured to dispense water into the washing tub;

a drain pump configured to remove water from the washing tub; and a control unit configured to:

operate the water inlet circuit to fill said washing tub with a first quantity of clean water that exceeds the quantity of water necessary to wet said loaded laundry completely, so as to obtain complete wetting of said loaded laundry;

rotate the washing drum so as to extract by squeezing any free water from said loaded laundry into the washing tub, the free water being water in excess of the quantity of water necessary to wet said loaded laundry completely;

operate the drain pump to drain the free water from the washing tub and discharge the free water from the washing machine; and operate the water inlet circuit to add a given quantity of detergent to said loaded laundry after the complete wetting of said loaded laundry and said draining of free water such that the tub contains only the loaded laundry, the quantity of water necessary to wet said loaded laundry completely, and the given quantity of detergent.

* * * * *